US011384979B2

(12) United States Patent
Powell

(10) Patent No.: US 11,384,979 B2
(45) Date of Patent: Jul. 12, 2022

(54) REFRIGERATED STORAGE SYSTEM

(71) Applicant: Delwanda Powell, Quitman, AR (US)

(72) Inventor: Delwanda Powell, Quitman, AR (US)

( * ) Notice: Subject to any disclaimer, the term of this patent is extended or adjusted under 35 U.S.C. 154(b) by 0 days.

(21) Appl. No.: 16/898,915

(22) Filed: Jun. 11, 2020

(65) Prior Publication Data

US 2021/0389047 A1 Dec. 16, 2021

(51) Int. Cl.
*F25D 25/02* (2006.01)
*F25D 23/02* (2006.01)

(52) U.S. Cl.
CPC ..... *F25D 25/027* (2013.01); *F25D 23/028* (2013.01)

(58) Field of Classification Search
CPC ..... F25D 25/027; F25D 23/028
See application file for complete search history.

(56) References Cited

U.S. PATENT DOCUMENTS 1,908,797 A * 5/1933 Svalland ..... A47B 49/004 312/305
2,153,682 A * 4/1939 Vicek ..... F25D 25/027 312/305
2,157,754 A 5/1939 Gould
2,182,003 A * 12/1939 Roark ..... F25D 25/027 108/138
D148,212 S 12/1947 Boyce
2,693,989 A * 11/1954 Santana ..... A47B 49/004 312/305
2,831,582 A * 4/1958 Cody ..... A47B 49/004 108/141
3,628,844 A * 12/1971 Preston ..... A47B 49/004 312/305
4,123,130 A * 10/1978 Locke ..... A47B 49/004 312/236
4,587,908 A * 5/1986 DeBruyn ..... A47B 49/006 108/142
5,403,079 A * 4/1995 Fetisoff ..... A47B 49/004 108/25
6,883,887 B1 * 4/2005 Mogensen ..... A47B 49/004 312/305
9,022,495 B1 5/2015 Conner, Sr.
9,255,729 B2 * 2/2016 Rindlisbach ..... F25D 29/005
10,215,479 B2 * 2/2019 Rindlisbach ..... F25D 23/061
2004/0040479 A1 * 3/2004 Searer ..... A47B 96/02 108/92
2014/0132128 A1 5/2014 Simon
2014/0300266 A1 * 10/2014 Rindlisbach ..... F25D 23/067 312/408
2018/0120022 A1 * 5/2018 Rindlisbach ..... F25D 25/027

FOREIGN PATENT DOCUMENTS

WO WO2010143973 12/2010

* cited by examiner

*Primary Examiner* — Kimberley S Wright

(57) ABSTRACT

A refrigerated storage system for incorporating rotatable shelves into a refrigerator includes a refrigerator that has a door. A first shelving unit is rotatably positioned within the refrigerator to support food items. The first shelving unit is selectively rotated to facilitate selected food items to be retrieved from the refrigerator. A second shelving unit is coupled to the door to support food items. The second shelving unit is movably positioned at a selected point along the door.

6 Claims, 3 Drawing Sheets

REFRIGERATED STORAGE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to refrigeration devices and more particularly pertains to a new refrigeration device incorporating rotatable shelves into a refrigerator.

BRIEF SUMMARY OF THE INVENTION

An embodiment of the disclosure meets the needs presented above by generally comprising a refrigerator that has a door. A first shelving unit is rotatably positioned within the refrigerator to support food items. The first shelving unit is selectively rotated to facilitate selected food items to be retrieved from the refrigerator. A second shelving unit is coupled to the door to support food items. The second shelving unit is movably positioned at a selected point along the door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
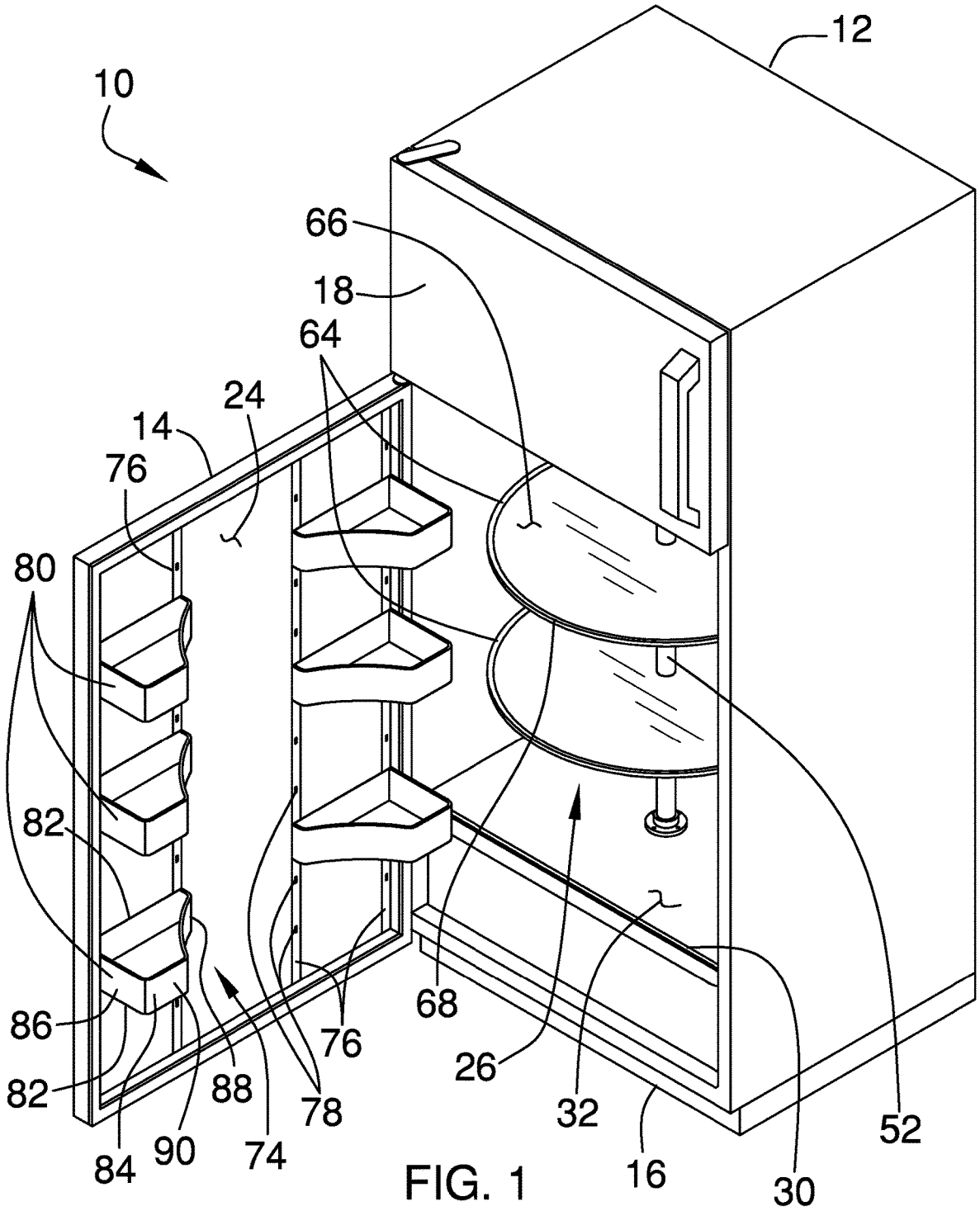
FIG. 1 is a front perspective view of a refrigerated storage system according to an embodiment of the disclosure.
Figure 2:
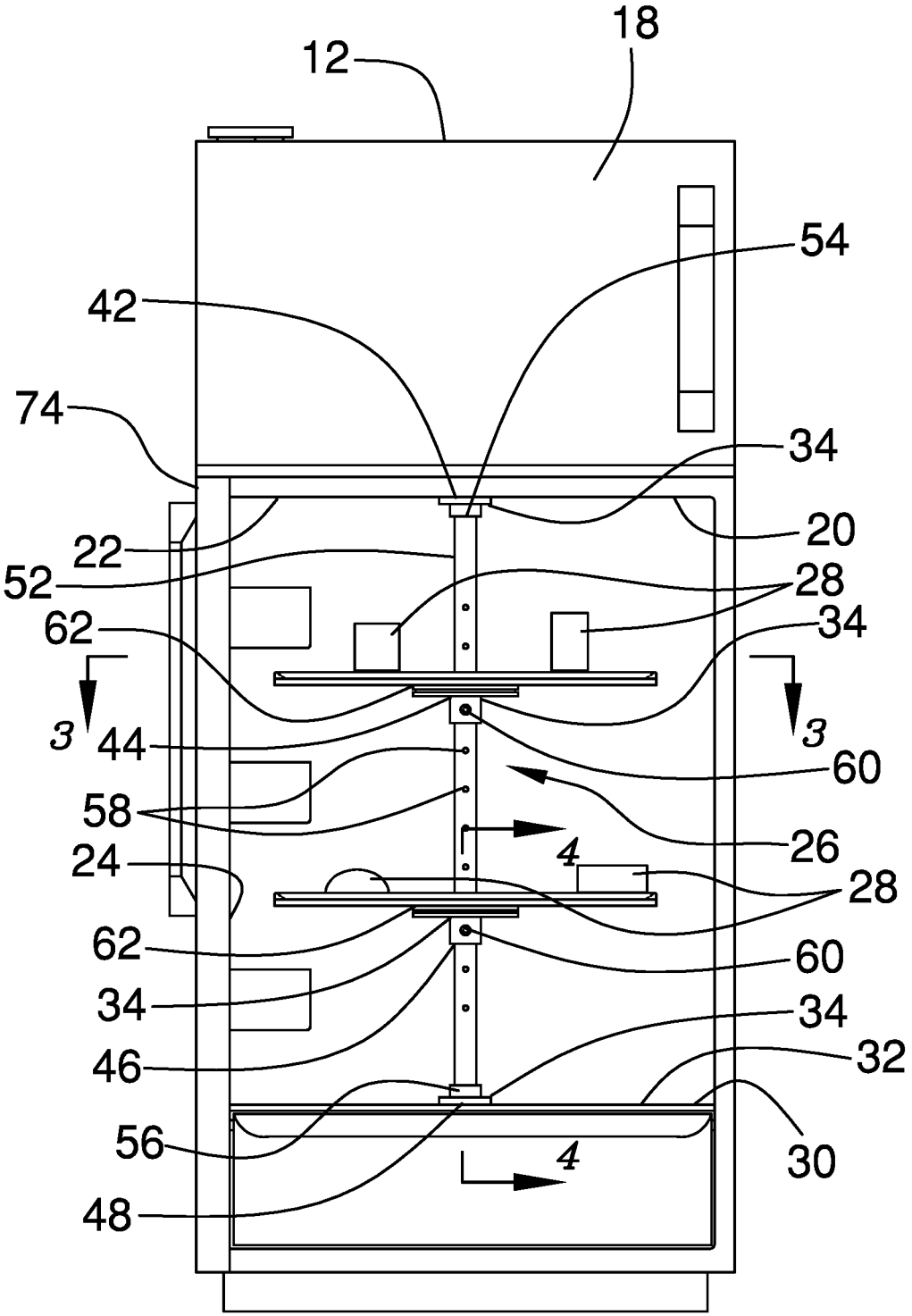
FIG. 2 is a front view of an embodiment of the disclosure.
Figure 3:
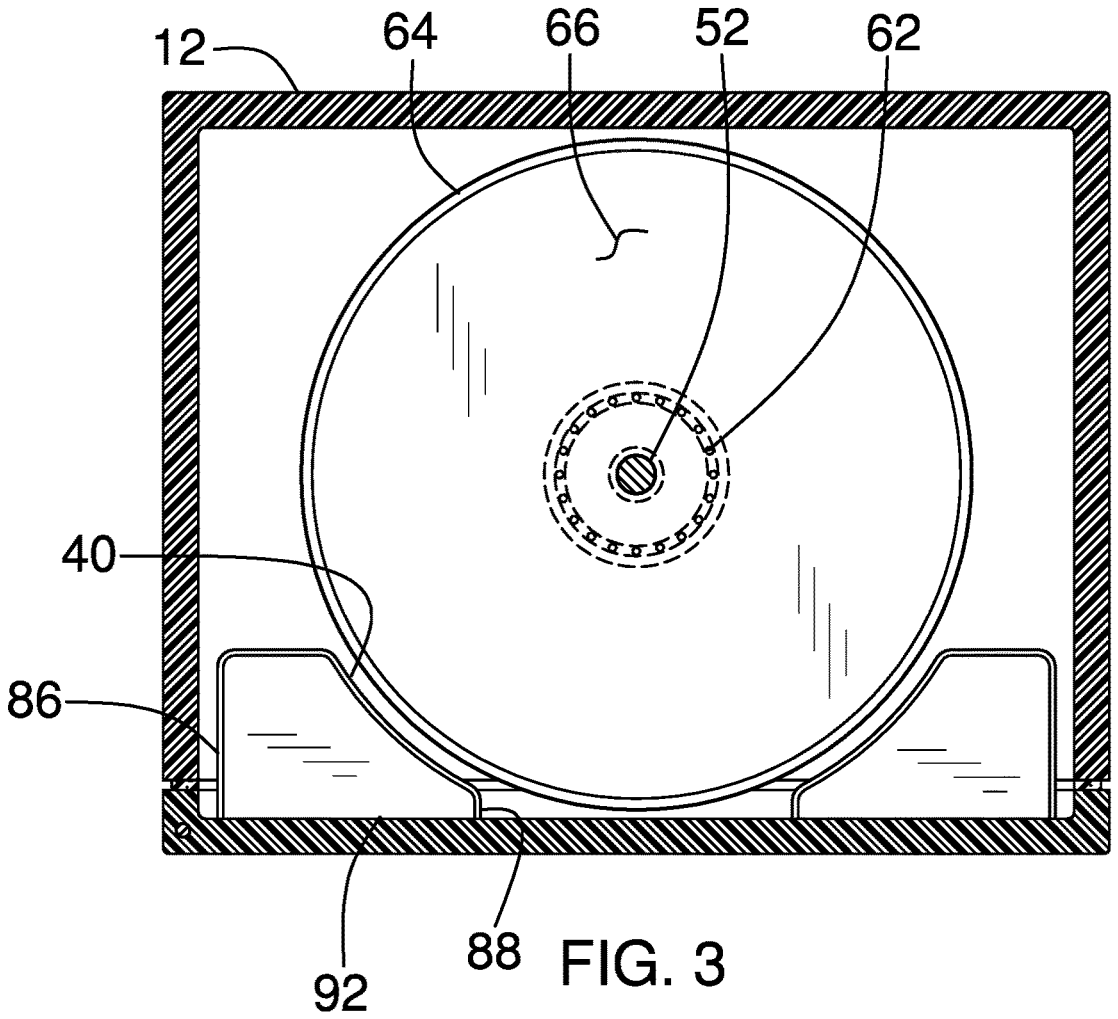
FIG. 3 is a cross sectional view taken along line 3-3 of FIG. 2 of an embodiment of the disclosure.
Figure 4:
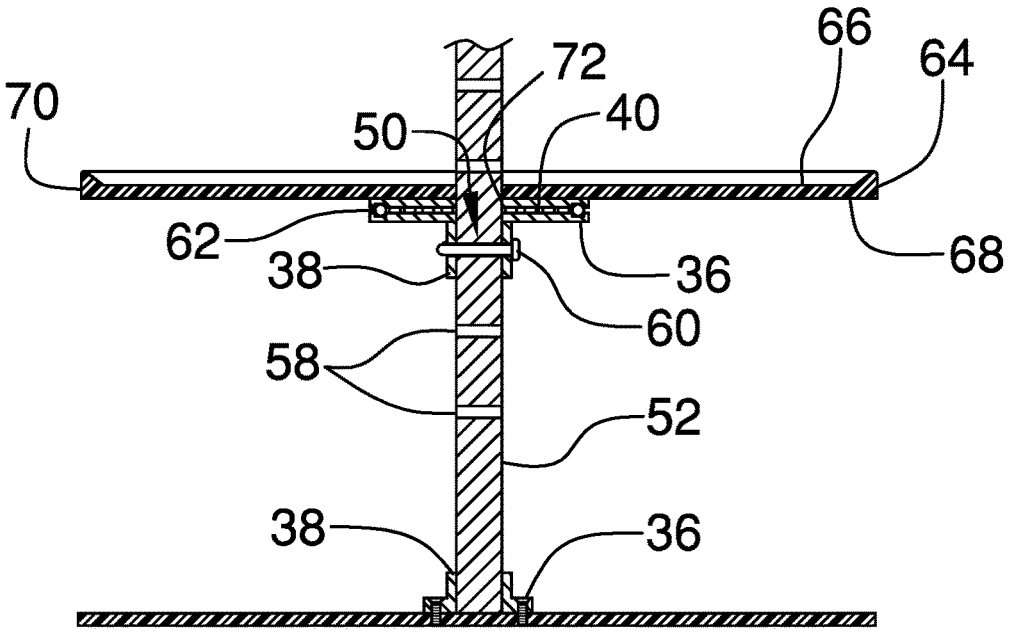
FIG. 4 is a cross sectional view taken along line 4-4 of FIG. 2 of an embodiment of the disclosure.

With reference now to the drawings, and in particular to FIGS. 1 through 4 thereof, a new refrigeration device embodying the principles and concepts of an embodiment of the disclosure and generally designated by the reference numeral 10 will be described.

As best illustrated in FIGS. 1 through 4, the refrigerated storage system 10 generally comprises a refrigerator 12 that has a door 14, a bottom wall 16, a freezer 18 and a bounding wall 20 between the freezer 18 and the refrigerator 12. The bounding wall 20 has a first surface 22 that faces the bottom wall 16 and the door 14 has a first surface 24 that engages the refrigerator 12 when the door 14 is closed. The refrigerator 12 may be an electric refrigerator of any conventional design such as a kitchen appliance or the like.

A first shelving unit 26 is rotatably positioned within the refrigerator 12 to support food items 28. The first shelving unit 26 is selectively rotated, in the convention of a lazy susan or the like, to facilitate selected food items 28 to be retrieved from the refrigerator 12. The first shelving unit 26 comprises a first shelf 30 that has an upper surface 32. The first shelf 30 is positioned within the refrigerator 12 and food items 28 are selectively positioned thereon. The first shelf 30 is spaced from the bottom wall 16 of the refrigerator 12.

A plurality of flanges 34 is provided and each of the flanges has a disk 36 and a receiver 38 extending away from the disk 36. The disk 36 has a primary surface 40 and the plurality of flanges 34 includes a first flange 42, a second flange 44, a third flange 46 and a fourth flange 48. The primary surface 40 corresponding to the first flange 42 is coupled to the first surface 22 of the bounding wall 20. Moreover, the first flange 42 is centrally positioned on the bounding wall 20. The disk 36 corresponding to the fourth flange 48 is coupled to the upper surface 32 of the first shelf 30 and the fourth flange 48 is centrally positioned on the first shelf 30. Each of the second 44 and third 46 flanges has a hole 50 extending therethrough. The hole 50 corresponding to each of the second 44 and third 46 flanges is aligned with the receiver 38 corresponding to the second 44 and third 46 flanges.

A rod 52 is provided that has a first end 54 and a second end 56 and the rod 52 has a plurality of apertures 58 extending therethrough. The apertures 58 are spaced apart from each other and are distributed between the first 54 and second 56 ends. The receiver 38 corresponding to the first flange 42 fixedly receives the first end 54. The receiver 38 corresponding to the fourth flange 48 fixedly receives the second end 56 and the rod 52 extends through the hole 50 in each of the second 44 and third 46 flanges.

A pair of pins 60 is provided and each of the pins 60 is extended through the receiver 38 in an associated one of the second 44 and third 46 flanges and engages a selected one of the apertures 58 in the rod 52. In this way each of the first 44 and second 46 flanges is retained at a selected point along the rod 52. A pair of bearings 62 is provided and each of the bearings 62 is positioned on the disk 36 of an associated one of the second 44 and third 46 flanges. Each of the bearings 62 may be ball bearings and any other type of friction reducing bearing.

A plurality of second shelves 64 is provided and each of the second shelves 64 has a top surface 66, a bottom surface 68 and a perimeter edge 70 extending therebetween. The perimeter edge 70 corresponding to each of the second shelves 64 is continuous such that each of the second shelves 64 has a disk shape. The food items 28 are positioned on the top surface 66 corresponding to each of the second shelves 64.

Each of the second shelves 64 has an opening 72 extending through the top 66 and bottom 68 surfaces and the opening 72 is centrally positioned on the corresponding shelf. The rod 52 extends through the opening 72 on each of the second shelves 64. Moreover, the bottom surface 68 corresponding to each of the second shelves 64 is positioned on an associated one of the bearings 62 such that each of the second shelves 64 is rotatable about the rod 52.

A second shelving unit 74 is provided and the second shelving unit 74 is coupled to the door 14 to support food items 28. The second shelving unit 74 is movably positioned at a selected point along the door 14. The second shelving unit 74 comprises a plurality of tracks 76 that is each coupled to the first surface of the door 14. Each of the tracks 76 is vertically oriented on the door 14 and each of the tracks 76 has a plurality of connection points 78. The connection points 78 corresponding to each of the tracks 76 are spaced apart from each other and are distributed along the corresponding track 76. The connection points 78 may comprise openings extending into the tracks 76 or the like.

A plurality of third shelves 80 is provided and each of the third shelves 80 has a lower wall 82 and a perimeter wall 84 extending upwardly therefrom. The perimeter wall 84 corresponding to each of the shelves has a first lateral side 86, a second lateral side 88, a front side 90 and a back side 92. The back side 92 corresponding to each of the third shelves 80 engages a selected one of the connection points 78 on the tracks 76. In this way each of the third shelves 80 is positioned at a selected point along the tracks 76. The front side 90 corresponding to each of the third shelves 80 is concavely arcuate between the first 86 and second 88 lateral side of the corresponding third shelves 80. Thus, the front side 90 corresponding to each of the third shelves 80 is inhibited from frictionally engaging the perimeter edge 70 corresponding to the second shelves 64 when the door 14 is closed.

In use, each of the second 44 and third 46 flanges is positioned at a selected point along the rod 52. Each of the pins 60 is extended through the receiver 38 of an associated of the second 44 and third 46 flanges to engage a selected one the apertures 58. Thus, each of the second shelves 64 is retained at a selected point along the rod 52. The food items 28 are positioned on the second shelves 64 and each of the second shelves 64 is selectively rotated about the rod 52 to access selected food items 28. Each of the third shelves 80 is positioned at selected points along the tracks 76 and food items 28 are positioned on each of the third shelves 80.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A refrigerated storage system comprising:

a refrigerator having a door, said door having a first surface;

a first shelving unit being rotatably positioned within said refrigerator wherein said first shelving unit is configured to support food items, said first shelving unit being selectively rotated wherein said first shelving unit is configured to facilitate selected food items to be retrieved from said refrigerator;

a second shelving unit being coupled to said door wherein said second shelving unit is configured to support food item, said second shelving unit being movably positioned at a selected point along said door, said second shelving unit comprising a plurality of tracks, each of said tracks being coupled to said first surface of said door, each of said tracks being vertically oriented on said door, wherein each of said tracks has a plurality of connection points, said connection points corresponding to each of said tracks being spaced apart from each other and being distributed along said corresponding track, wherein said second shelving unit includes a plurality of third shelves, each of said third shelves having a lower wall and a perimeter wall extending upwardly therefrom, said perimeter wall corresponding to each of said shelves having a first lateral side, a second lateral side, a front side and a back side, said back side corresponding to each of said third shelves engaging a selected one of said connection points on said tracks such that each of said third shelves is positioned at a selected point along said tracks, wherein said front side corresponding to each of said third shelves is concavely arcuate between said first and second lateral side of said corresponding third shelves such that said front side corresponding to each of said third shelves is inhibited from frictionally engaging said perimeter edge corresponding to said second shelves when said door is closed;

a plurality of flanges, each of said flanges having a disk and a receiver extending away from said disk, said disk having a primary surface, said plurality of flanges including a first flange, a second flange, a third flange and a fourth flange;

wherein said refrigerator has a bounding wall, said hounding wall having a first surface;

wherein said first shelving unit includes a first shelf having a upper surface;

said primary surface corresponding to said first flange being coupled to said first surface of said bounding wall, said first flange being centrally positioned on said bounding wall, said disk corresponding to said fourth flange being coupled to said upper surface of said first shelf said fourth flange being centrally positioned on said first shelf;

wherein each of said second and third flanges has a hole extending therethrough, said hole corresponding to each of said second and third flanges being aligned with said receiver corresponding to said second and third flanges; and a rod having a first end and a second end, said rod having a plurality of apertures extending therethrough, said apertures being spaced apart from each other and being distributed between said first and second ends, said receiver corresponding to said first flange fixedly receiving said first end, said receiver corresponding to said fourth flange fixedly receiving said second end, said rod extending through said hole in each of said second and third flanges.

2. The system according to claim 1, wherein:

said refrigerator has a bottom wall; and said first shelving unit comprises a first shelf having an upper surface, said first shelf being positioned within said refrigerator wherein said upper surface is configured to have food items positioned thereon, said first shelf being spaced from said bottom wall.

3. The system according to claim 1, further comprising a pair of pins, each of said pins extending through said receiver in an associated one of said second and third flanges and engaging a selected one of said apertures in said rod such that each of said first and second flanges is retained at a selected point along said rod.

4. The system according to claim 1, further comprising a pair of bearings, each of said bearings being positioned on said disk of an associated one of said second and third flanges.

5. The system according to claim 1, wherein said first shelving unit includes a plurality of second shelves, each of said second shelves having a top surface, a bottom surface and a perimeter edge extending therebetween, said perimeter edge corresponding to each of said second shelves being continuous such that each of said second shelves has a disk shape, said top surface corresponding to each of said second shelves being configured to have the food items positioned thereon.

6. A refrigerated storage system comprising:

a refrigerator having a door, a bottom wall, a bounding wall between a freezer and said refrigerator, said bounding wall having a first surface facing said bottom wall, said door having a first surface engaging said refrigerator when said door is closed;

a first shelving unit being rotatably positioned within said refrigerator wherein said first shelving unit is configured to support food items, said first shelving unit being selectively rotated wherein said first shelving unit is configured to facilitate selected food items to be retrieved from said refrigerator, said first shelving unit comprising:

a first shelf having an upper surface, said first shelf being positioned within said refrigerator wherein said upper surface is configured to have food items positioned thereon, said first shelf being spaced from said bottom wall;

a plurality of flanges, each of said flanges having a disk and a receiver extending away from said disk, said disk having a primary surface, said plurality of flanges including a first flange, a second flange, a third flange and a fourth flange, said primary surface corresponding to said first flange being coupled to said first surface of said bounding wall, said first flange being centrally positioned on said bounding wall, said disk corresponding to said fourth flange being coupled to said upper surface of said first shelf, said fourth flange being centrally positioned on said first shelf, each of said second and third flanges having a hole extending therethrough, said hole corresponding to each of said second and third flanges being aligned with said receiver corresponding to said second and third flanges;

a rod having a first end and a second end, said rod having a plurality of apertures extending therethrough, said apertures being spaced apart from each other and being distributed between said first and second ends, said receiver corresponding to said first flange fixedly receiving said first end, said receiver corresponding to said fourth flange fixedly receiving said second end, said rod extending through said hole in each of said second and third flanges;

a pair of pins, each of said pins extending through said receiver in an associated one of said second and third flanges and engaging a selected one of said apertures in said rod such that each of said first and second flanges is retained at a selected point along said rod;

a pair of bearings, each of said bearings being positioned on said disk of an associated one of said second and third flanges; and a plurality of second shelves, each of said second shelves having a top surface; a bottom surface and a perimeter edge extending therebetween, said perimeter edge corresponding to each of said second shelves being continuous such that each of said second shelves has a disk shape, said top surface corresponding to each of said second shelves being configured to have the food items positioned thereon, each of said second shelves having an opening extending through said top and bottom surfaces, said opening being centrally positioned on said corresponding shelf, said rod extending through said opening on each of said second shelves, said bottom surface corresponding to each of said second shelves being positioned on an associated one of said bearings such that each of said shelves is rotatable about said rod; and a second shelving unit being coupled to said door wherein said second shelving unit is configured to support food item, said second shelving unit being movably positioned at a selected point along said door, said second shelving unit comprising:

a plurality of tracks, each of said tracks being coupled to said first surface of said door, each of said tracks being vertically oriented on said door, each of said tracks having a plurality of connection points, said connection points corresponding to each of said tracks being spaced apart from each other and being distributed along said corresponding track; and a plurality of third shelves, each of said third shelves having a lower wall and a perimeter wall extending upwardly therefrom, said perimeter wall corresponding to each of said shelves having a first lateral side, a second lateral side, a front side and a back side, said back side corresponding to each of said third shelves engaging a selected one of said connection points on said tracks such that each of said third shelves is positioned at a selected point along said tracks, said front side corresponding to each of said third shelves being concavely arcuate between said first and second lateral side of said corresponding third shelves such that said front side corresponding to each of said third shelves is inhibited from frictionally engaging said perimeter edge corresponding to said second shelves when said door is closed.

* * * * *